US006747532B1

(12) United States Patent
Tobin et al.

(10) Patent No.: US 6,747,532 B1
(45) Date of Patent: Jun. 8, 2004

(54) METHOD, SYSTEM AND APPARATUS FOR EMPLOYING NEUTRAL POLES IN MULTIPOLE CIRCUIT BREAKERS

(75) Inventors: Michael Tobin, Burlington, CT (US); Girish Hassan, Secunderabad (IN); Michael Ronzello, Bristol, CT (US); Ramakrishna Kalagotla, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/248,173

(22) Filed: Dec. 23, 2002

(51) Int. Cl.[7] ..... H01H 75/00; H01H 77/00; H01H 83/00

(52) U.S. Cl. ..... 335/6; 335/8; 335/11; 335/13

(58) Field of Search ..... 335/6, 8, 10, 11, 335/13

(56) References Cited

U.S. PATENT DOCUMENTS

| | | | | |
|---|---|---|---|---|
| 4,087,469 | A | 5/1978 | Gurvich et al. | 568/723 |
| 4,087,769 | A | 5/1978 | Di Marco et al. | 335/16 |
| 4,144,513 | A | 3/1979 | Shaffer et al. | 335/46 |
| 4,251,702 | A | 2/1981 | Castonguay et al. | 200/153 SC |
| 4,281,303 | A | 7/1981 | Heft | 335/16 |
| 4,376,270 | A | 3/1983 | Staffen | 335/21 |
| 4,383,146 | A | 5/1983 | Bur | 200/17 R |
| 4,458,224 | A | 7/1984 | Kralik et al. | 335/16 |
| 4,480,242 | A | 10/1984 | Castonguay et al. | 335/194 |
| 4,539,538 | A | 9/1985 | Flick et al. | 335/16 |
| 4,540,961 | A | 9/1985 | Maier | 335/16 |
| 4,553,119 | A | 11/1985 | Castonguay et al. | 335/147 |
| 4,574,170 | A | 3/1986 | Abe et al. | 200/153 G |
| 4,635,011 | A | 1/1987 | Leone et al. | 335/16 |
| 4,644,120 | A | 2/1987 | Tedesco | 200/153 G |
| 4,644,121 | A | 2/1987 | McKee et al. | 200/153 G |
| 4,645,890 | A | 2/1987 | Paton et al. | 200/153 G |
| 4,845,459 | A | 7/1989 | Manthe et al. | 335/195 |
| 4,849,726 | A | 7/1989 | Miura et al. | 335/195 |
| 4,882,557 | A | 11/1989 | Harper | 335/9 |
| 5,357,066 | A | 10/1994 | Morel et al. | 200/17 R |
| 5,363,076 | A | 11/1994 | Miller et al. | 335/16 |
| 6,114,641 | A | 9/2000 | Castonguay et al. | 200/244 |

FOREIGN PATENT DOCUMENTS

| | | | |
|---|---|---|---|
| EP | 0 189 887 B1 | 1/1992 | H01H/71/44 |

*Primary Examiner*—Ramon M. Barrera
(74) *Attorney, Agent, or Firm*—Cantor Colburn LLP

(57) ABSTRACT

A neutral pole for a multipole circuit breaker is disclosed. The circuit breaker includes a housing, a plurality of contact arms for opening and closing an electrical circuit, and an operating mechanism for driving the contact arms. The neutral pole includes a neutral housing, a conduction path within the neutral housing having a neutral arm arranged to open and close the conduction path, a bias spring configured to exert a first bias moment on the neutral arm when the conduction path is closed, a spring support configured to support the bias spring, a rotor pivotally arranged within the neutral housing and configured to displace the neutral arm and to open the conduction path, and a drive pin configured to couple the rotor to the multipole circuit breaker. The spring support is fixedly arranged at the neutral housing. The rotor is responsive to the opening and closing action of the operating mechanism of the multipole circuit breaker.

14 Claims, 7 Drawing Sheets

METHOD, SYSTEM AND APPARATUS FOR EMPLOYING NEUTRAL POLES IN MULTIPOLE CIRCUIT BREAKERS

BACKGROUND OF THE INVENTION

The present disclosure relates generally to multipole circuit breakers, and particularly to neutral poles for use in multipole circuit breakers.

Multipole circuit breakers configured to protect multiphase electrical circuits are known in the electrical circuit protection industry. The variety of constructions of multipole circuit breakers include blow open and non-blow open contact arms, overcentering and non-overcentering contact arms, single contact pair arrangements with the contact pair at one end of a contact arm and a pivot at the other end thereof, double contact pair arrangements (referred to as rotary breakers) with a contact pair at each end of a contact arm and a contact arm pivot intermediate (typically centrally located between) the two ends, single housing constructions with the circuit breaker components housed within a single case and cover, and cassette type constructions (referred to as cassette breakers) with the current carrying components of each phase housed within a phase cassette and each phase cassette housed within a case and cover that also houses the operating mechanism. Multipole circuit breakers are generally available in two, three, and four pole arrangements, with the two and three pole arrangements being commonly used in two and three phase circuits, respectively. Four pole arrangements are typically employed on three phase circuits having switching neutrals, where the fourth pole operates to open and close the neutral circuit in a coordinated arrangement with the opening and closing of the primary circuit phases. Some fourth pole neutrals have identical constructions to the phase poles and are simply appended onto an outer pole by way of an extended crossbar or drive rod. The combination, however, of a phase pole construction and an extended drive rod typically results in less contact depression in the neutral pole due to the additional strain on the drive rod, the fourth pole neutral being that much further removed from the operating mechanism. To address the anticipated reduction in contact depression, design modifications within the circuit breaker may be employed. Other fourth pole neutrals have supplemental fourth pole operating mechanisms specifically arranged for operating only the fourth pole neutral. While a supplemental fourth pole operating mechanism is effective in controlling lost contact depression to due additional strain, it also typically involves higher complexity and cost compared to a construction without a supplemental operating mechanism. In view of present fourth pole neutral arrangements, it is desirable to have a fourth pole neutral that overcomes the above disadvantages.

SUMMARY OF THE INVENTION

In one embodiment, a neutral pole for a multipole circuit breaker is disclosed. The circuit breaker includes a housing, a plurality of contact arms for opening and closing an electrical circuit and an operating mechanism for driving the contact arms. The neutral pole includes a neutral housing, a conduction path within the neutral housing having a neutral arm arranged for opening and closing the conduction path, a bias spring configured to exert a first bias moment on the neutral arm when the conduction path is closed, a spring support configured to support the bias spring, a rotor pivotally arranged within the neutral housing and configured to displace the neutral arm and open the conduction path, and a drive pin configured to couple the rotor to the multipole circuit breaker. The spring support is fixedly arranged at the neutral housing. The rotor is responsive to the opening and closing action of the operating mechanism of the multipole circuit breaker.

In another embodiment, a multipole circuit breaker includes a main housing, a main conduction path having contact arms configured to open and close an electrical circuit, an operating mechanism configured to drive the contact arms, and a neutral pole. The neutral pole includes a neutral housing in fixed arrangement with the main housing, a neutral conduction path within the neutral housing having a neutral arm arranged to open and close the neutral conduction path, a bias spring configured to exert a first bias force on said neutral arm when said neutral conduction path is closed, a spring support configured to support the bias spring, a rotor pivotally arranged within said neutral housing and arranged to displace the neutral arm and to open the neutral conduction path, and a drive pin configured to couple the rotor to the operating mechanism. The spring support is fixedly coupled to the neutral housing. The rotor is responsive to the opening and closing action of the operating mechanism.

In a further embodiment, a method for opening a neutral pole of a multipole circuit breaker includes receiving an opening command at the neutral pole from the multipole circuit breaker, and responding to the opening command to open the neutral conduction path by rotating a neutral rotor a first angular displacement under no load from a set of neutral bias springs and a second angular displacement under load from the set of neutral bias springs.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a multipole circuit breaker with a fourth neutral pole that is actuated by the operating mechanism of the main circuit breaker. While the embodiment described herein depicts a neutral pole as an exemplary fourth pole neutral, it will be appreciated that the disclosed invention is also applicable to other multipole circuit breakers that require the functionality of an auxiliary switching pole herein disclosed, such as two-pole circuit breaker or switch with auxiliary third pole for a control circuit for example.

Figure 1:
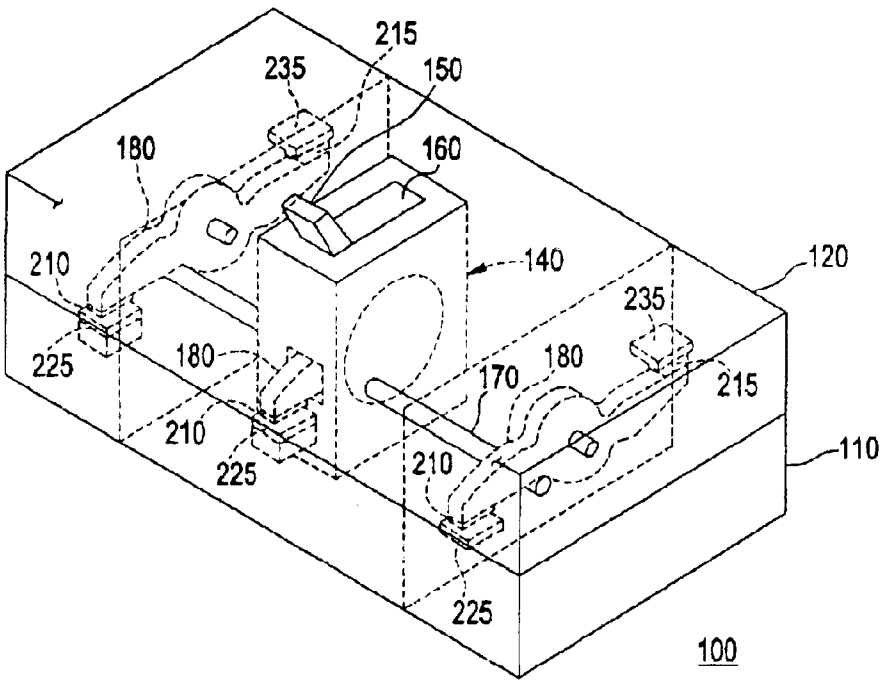
FIG. 1 is an exemplary multiphase circuit breaker for use in an embodiment of the invention.
Figure 2:
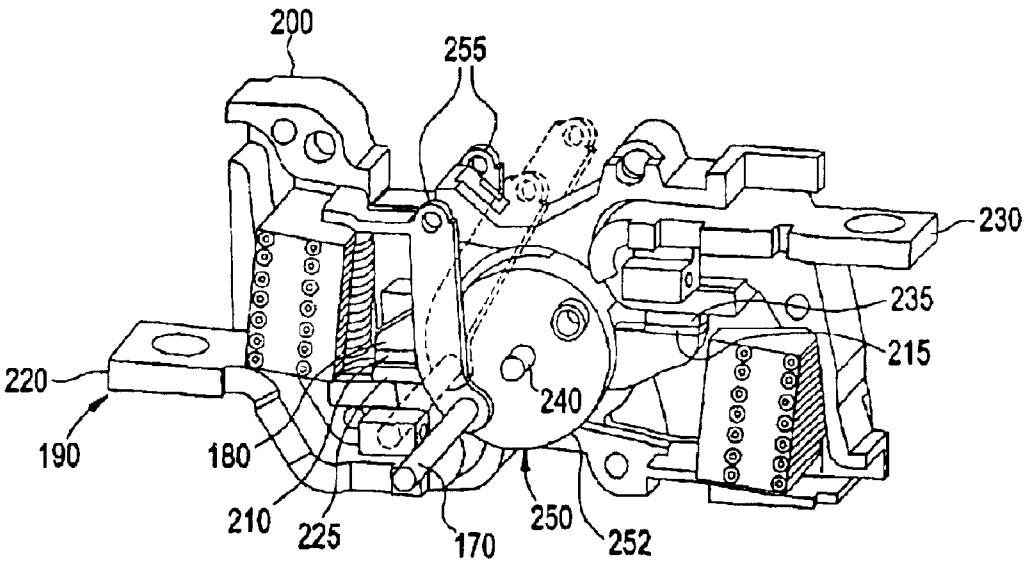
FIG. 2 is an isometric view of one phase of the exemplary multiphase circuit breaker of FIG. 1.

An exemplary multipole circuit breaker 100 is depicted in FIG. 1 having a base 110 and a cover 120. Within base and cover 110, 120 are cassettes 200 (discussed below in reference to FIG. 2) that provide a main housing for electrical conductors and circuit interrupters. An operating mechanism 140 for turning circuit breaker 100 ON and OFF includes an operating handle 150 that protrudes through aperture 160 of cover 120, and a drive pin 170 for driving a set of contact arms 180 of a main conduction path 190 that is best seen by now referring to FIG. 2. An embodiment of circuit breaker 100 is arranged with conduction path 190 housed within a cassette 200, but the present invention is not limited to the use of a cassette-type construction. Main conduction path 190 includes a contact arm 180 with movable contacts 210, 215 at opposite ends thereof, a line strap 220, a line contact 225, a load strap 230, and a load contact 235. When circuit breaker 100 is connected to an electrical circuit via connectors (not shown) on line and load straps 220, 230 and is turned ON, the electrical current flows through line strap 220, line contact 225, movable contact 210, contact arm 180, movable contact 215, load contact 235, and load strap 230. Operating mechanism 140 opens and closes conduction path 190 by rotating drive pin 170 about axis 240, which in turn drives contact assembly 250 for ON/OFF actuation of contact arm 180. Mechanism links 255 connect contact assembly 250 to operating mechanism 140. A further description of the operating characteristics of exemplary circuit breaker 100 is disclosed in commonly assigned U.S. Pat. No. 6,114,641 entitled "Rotary Contact Assembly for High Ampere-Rated Circuit Breakers" filed May 29, 1998.

Figure 3:
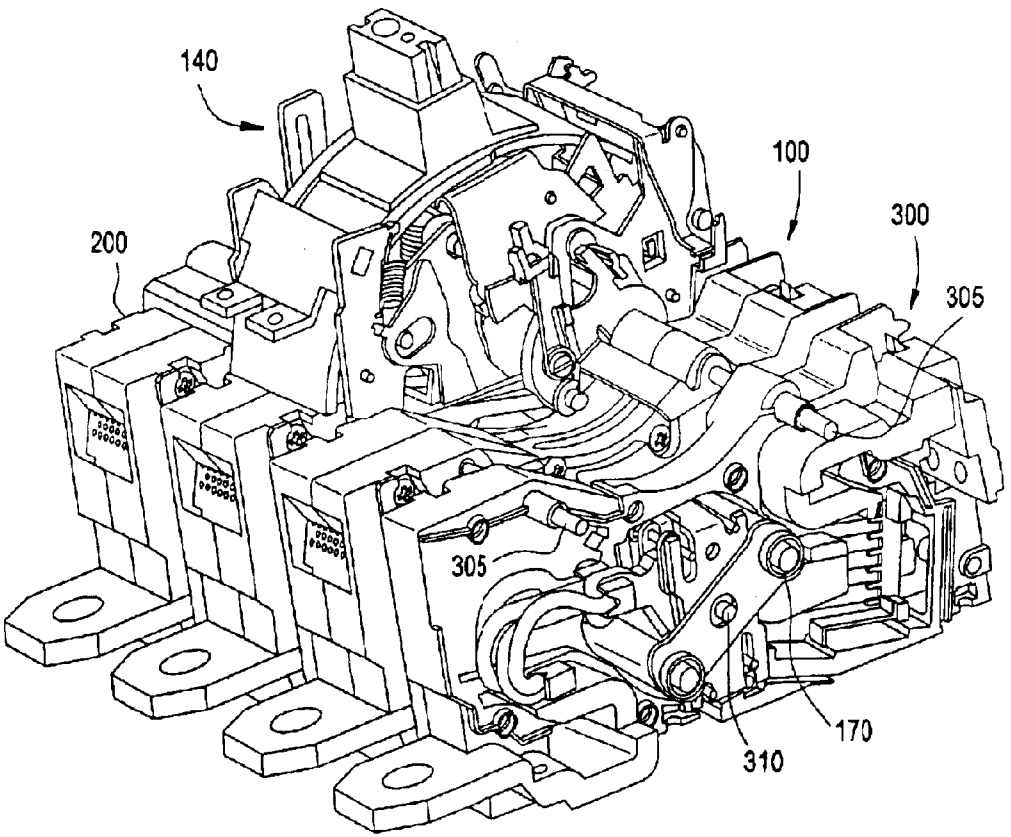
FIG. 3 is the exemplary multiphase circuit breaker of FIG. 1 having a neutral pole in accordance with an embodiment of the invention.

A neutral pole 300, best seen by now referring to FIG. 3, is connected to cassettes 200 of circuit breaker 100 via fasteners 305, such as rivets, bolts, or the like. Operating mechanism 140 of circuit breaker 100 serves to operate both circuit breaker 100 and neutral pole 300. Drive pin 170 is coupled to operating mechanism 140 via mechanism links 255 and delivers the rotational moment about common pivot 310 when operating mechanism 140 is actuated.

Figure 4:
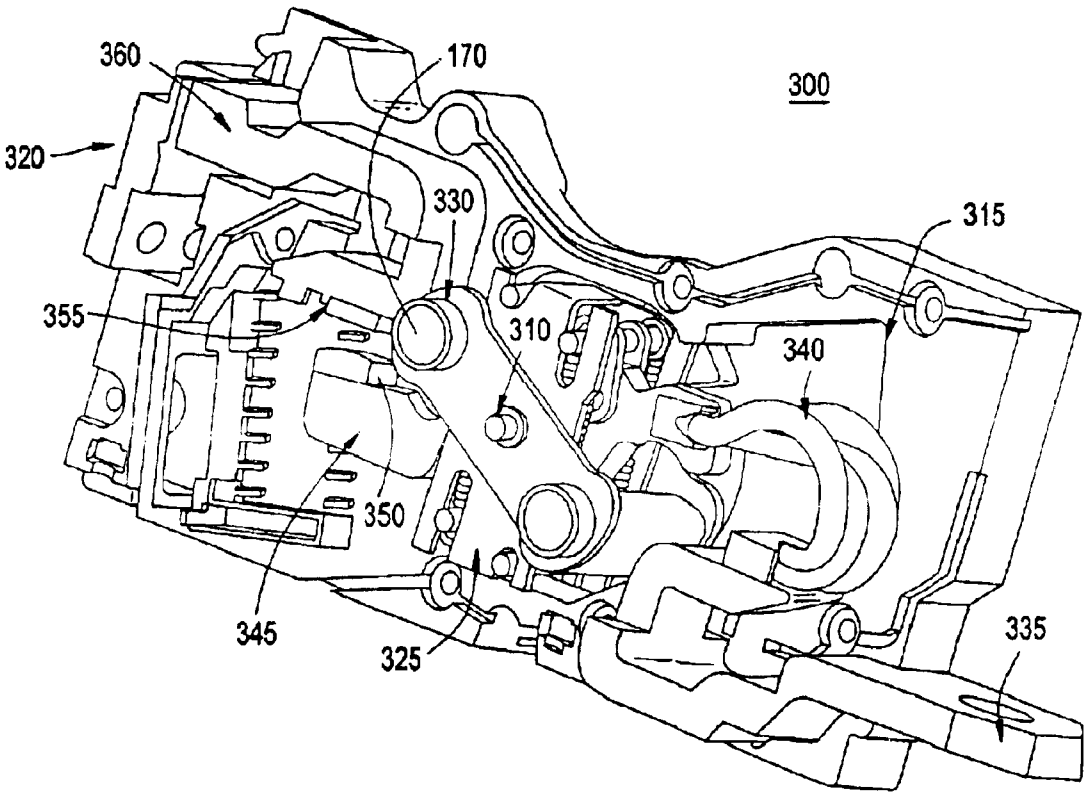
FIG. 4 is an isometric view of the neutral pole of FIG. 3.

Referring now to FIG. 4, an alternative view of neutral pole 300 with a side cover removed is depicted having a neutral housing 315 (minus the side cover), a neutral conduction path 320, a spring support 325 fixedly coupled to neutral housing 315 by an interlocking projection and hole, or any other suitable means, a rotor 330 pivotally arranged within neutral housing 315 about common pivot 310, and drive pin 170 for coupling rotor 330 to operating mechanism 140 as discussed above. Through drive pin 170, rotor 330 is responsive to the opening and closing action of operating mechanism 140.

Neutral conduction path 320 includes a neutral line strap 335, a flexible conductor 340, such as copper braid for example, a neutral arm 345 pivotally arranged at common pivot 310 and arranged for opening and closing neutral conduction path 320, a neutral movable contact 350, a neutral fixed contact 355, and a neutral load strap 360. When operating mechanism 140 is turned ON, neutral current, when present, passes through neutral line strap 335, flexible conductor 340, neutral arm 345, neutral movable contact 350, neutral fixed contact 355, and neutral load strap 360. Connectors (not shown) connect neutral line and load straps 335, 360 to neutral circuit (not shown). When operating mechanism 140 is turned OFF, drive pin 170 acts upon rotor 330 to displace neutral arm 345 and open neutral conduction path 320, as will be discussed in more detail below in reference to FIG. 6.

Figure 5:
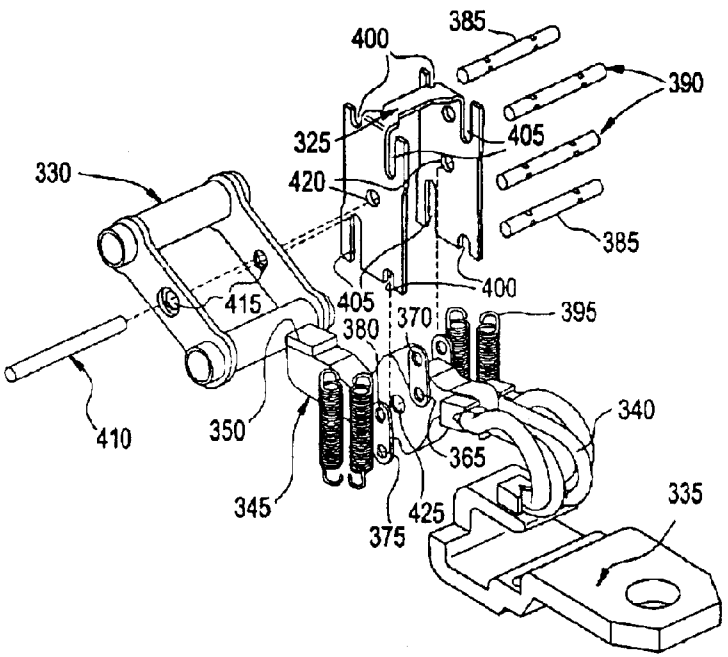
FIG. 5 is an exploded assembly view of several components of the neutral pole of FIG. 3.

Referring now to FIG. 5, an exploded assembly view of neutral conduction path 320, spring support 325, and rotor 330 is depicted. Neutral arm 345 includes four neutral arm links 365 (three are shown and one is hidden behind neutral arm 345), each neutral arm link 365 has two holes 370, 375, one at each end. A first hole 370 is pivotally coupled to neutral arm 345 by a pivot pin 380, and a second hole 375 is for receiving a translational spring anchor pin 390 (see also FIG. 4). Bias springs 395, depicted as tension springs, have one end anchored to a non-translational spring anchor pin 385 and the other end anchored to a translational spring anchor pin 390. Bias springs 395 provide a bias force to bias neutral arm 345 in the ON direction to close neutral conduction path 320, and are supported by spring support 325. Non-translational spring anchor pins 385 are received in non-translational slots 400 on spring support 325, and translational spring anchor pins 390 are received in translational slot 405 on spring support 325. Slots 400, 405 permit rotation of pins 385, 390, but only translational slots 405 permit translation of translational spring anchor pins 390. After bias springs 395 are assembled to spring anchor pins 385, 390, and spring anchor pins 385, 390 are assembled to spring support 325 as discussed above, rotor 330 is placed over spring support 325 and common pivot pin 410 is assembled through common pivot holes 415, 420, 425.

Figure 6:
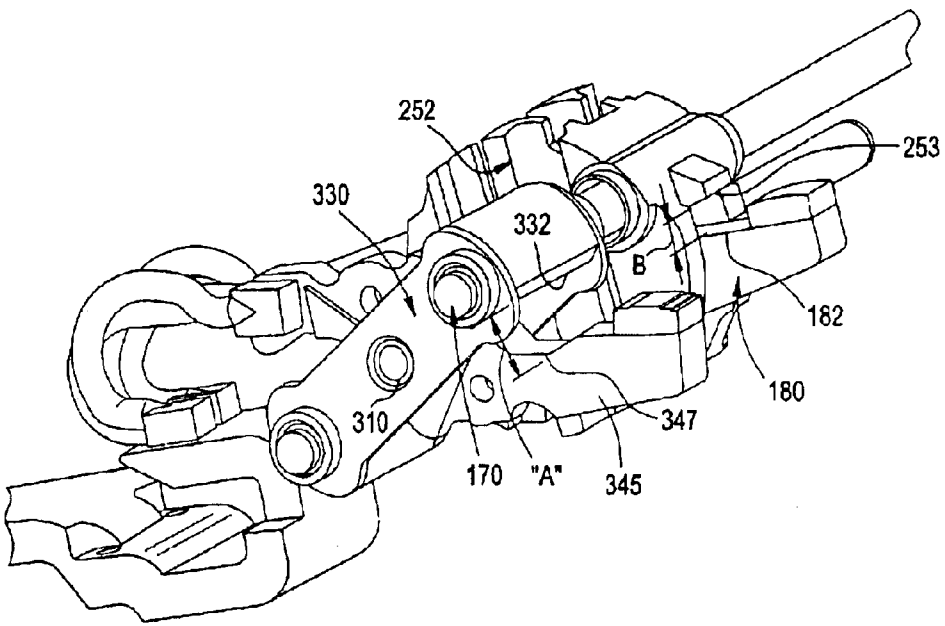
FIG. 6 is an isometric view of an exemplary rotor and contact arm arrangement in accordance with an embodiment of the invention.

The opening action of neutral arm 345 is best seen by now referring to FIG. 6, which depicts a portion of neutral conduction path 320, specifically showing neutral arm 345, and a portion of main conduction path 190, specifically showing contact arm 180 of circuit breaker 100. Also shown is a phase rotor 252 of circuit breaker 100 and rotor 330 of neutral pole 300. Phase rotor 252 has an engagement surface 253, which engages pickup surface 182 on contact arm 180, and rotor 330 has an engagement surface 332, which engages pickup surface 347 on neutral arm 345, when operating mechanism 140 drives circuit breaker 100 and neutral pole 300 to the OFF position. The distance between engagement surface 332 and pickup surface 347 at neutral pole 300 is depicted as dimension "A". The distance between engagement surface 253 and pickup surface 182 at circuit breaker 100 is depicted as dimension "B". In an embodiment of the invention, dimension "A" is greater than dimension "B", resulting in contact arm 180 being picked up before neutral arm 330 is picked up as operating mechanism 140 drives drive pin 170 and rotors 252, 330 to the OFF position, which results in delayed opening of neutral contacts 350, 355. In one aspect of the invention, neutral arm 345 is not picked up until contact arm 180 has opened far enough to establish an air gap between contact pairs 210, 225 and 215, 235 of circuit breaker 100. In the direction of closing, contact pairs 210, 225 and 215, 235 of circuit breaker 100 will make contact subsequent to the neutral contact pair 350, 355. In this manner, the fourth pole neutral 300 is considered to be of a first to make and last to break construction, which enables the neutral circuit to be closed when switching the main phase circuits.

Referring now to FIGS. 4-6 collectively, rotor 330 is in a first orientation when neutral conduction path 320 is closed and gap "A" is at its maximum, in a second orientation when engagement surface 332 picks up pickup surface 347 and gap "A" is at zero, and in a third orientation when neutral conduction path 320 is open. When rotor 330 is between the first orientation and the second orientation, rotor 330 has not yet picked up neutral arm 345 and therefore rotor 330 does not experience any force feedback from bias spring 395 through neutral arm 345 to rotor 330, that is, the spring force of bias spring 395 Is not transmitted through neutral arm 345 to rotor 330. Alternatively, when rotor 330 is between the first and second orientations, bias spring 395 is isolated from rotor 330. Under this no-load condition, rotor 330 is referred to as being in a free-wheel mode, which reduces the strain on drive pin 170. When rotor 330 is between the second orientation and the third orientation, rotor 330 has picked up neutral arm 345 and therefore does experience a force being fed back from bias spring 395 through neutral arm 345 to rotor 330, that is, the spring force of bias spring 395 is transmitted through neutral arm 345 to rotor 330. Alternatively, when rotor 330 is between the second and third orientations, bias spring 395 is coupled to rotor 330. In this second condition, rotor 330 is referred to as being in a loaded condition.

Figure 7:
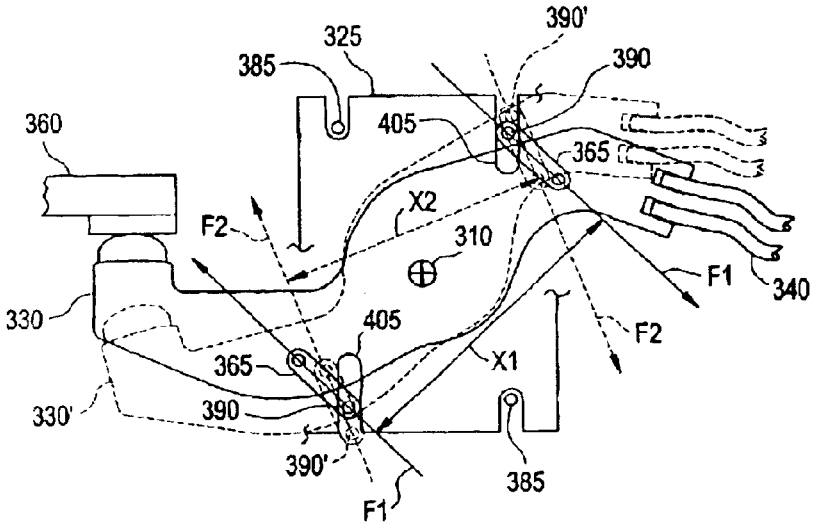
FIG. 7 is a side view of an exemplary neutral pole of an embodiment of the invention in both the closed and open positions.

The spring bias moment exerted on closed neutral arm 330 and open neutral arm 330' by bias spring 395 and neutral links 365 is best seen by now referring to FIG. 7, which depicts closed neutral arm 330 in solid line fashion and open neutral arm 330' in phantom line fashion. For clarification, bias spring 395 is not shown in FIG. 7, however, it is readily understood from the description above that bias spring 395 is anchored between non-translational spring anchor pin 385 and translational spring anchor pin 390. As neutral arm 330 pivots counterclockwise about common pivot 310 in fixed spring support 325, translational spring anchor pin 390 translates along translational slot 405 to the position depicted by 390', resulting in a change in angle of neutral arm links 365 with respect to spring support 325, and therefore a change in force vector, depicted by F1, F2. As a result, the closed moment M1, depicted by force F1 and perpendicular distance X1, reduces by a predefined amount to produce the open moment M2, depicted by force F2 and perpendicular distance X2. The reduced moment during opening is a result of distance X2 reducing in magnitude at a faster rate than F2 increases in magnitude. In one embodiment of the invention, the closed moment M1 is greater than the open moment M2, and both moments bias neutral arm 330 to the closed position. It will be appreciated that other embodiments may employ other open and closed moments without detracting from the scope of the invention. As shown in FIGS. 6 and 7, neutral arm 330 can pivot about common pivot 310 independent of rotor 330, thereby enabling neutral arm 330 to blow open for effective interruption when blow open current conditions exist in the neutral pole 300.

An embodiment of neutral pole 300 opens according to the following procedure. The actuation of operating mechanism 140 in the OPEN direction results in a clockwise rotation (viewed from FIG. 6) of drive pin 170 about common pivot 310, which provides the opening command received at neutral pole 300. In response to the opening command, rotor 330 rotates a first angular distance to close the gap "A" (seen in FIG. 6) at which point engagement surface 332 on rotor 330 engages pickup surface 347 on neutral arm 345, and then a second angular distance that separates neutral movable contact 350 away from neutral fixed contact 355 until neutral pole 300 is fully open. During the first angular displacement of rotor 330, the spring load of bias springs 395 is self contained within spring support 325, thereby resulting in a no load condition at rotor 330 as gap "A" closes with neutral conduction path 320 closed. This no load condition is also referred to as a free-wheel condition. During the second angular displacement of rotor 330, the spring load of bias springs 395 is transmitted through translational spring anchor pin 390, neutral arm link 365, and neutral arm 345 to rotor 330 via pickup surface 347 and engagement surface 332, thereby resulting in a loaded condition at rotor 330 as rotor 330 opens neutral conduction path 320. In an embodiment where gap "A" is greater than gap "B", rotor 330 will pickup neutral arm 345 via surfaces 332, 347 and open neutral conduction path 320 after circuit breaker contact pairs 210, 225 and 215, 235 have opened in response to operating mechanism 140.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method for opening a neutral pole of a multipole circuit breaker, comprising:

receiving an opening command at the neutral pole from the multipole circuit breaker; and responding to the opening command to open the neutral conduction path by rotating a neutral rotor a first angular displacement under no load from a set of neutral bias springs and a second angular displacement under load from the set of neutral bias springs.

2. The method of claim 1, wherein said responding to the opening command further comprises:

rotating the neutral rotor the first angular displacement with the neutral conduction path closed; and rotating the neutral rotor the second angular displacement with the neutral conduction path open.

3. The method of claim 2, wherein said rotating the neutral rotor the second angular displacement further comprises:

rotating the neutral rotor beyond the point that neutral conduction path opens subsequent to the opening of the main contacts of the multipole circuit breaker by an operating mechanism.

4. A neutral pole for a multipole circuit breaker, the circuit breaker having a housing, a plurality of contact arms for opening and closing an electrical circuit and an operating mechanism for driving the contact arms, the neutral pole comprising:

a neutral housing;

a conduction path within said neutral housing leaving a neutral arm arranged to open and close said conduction path;

a bias spring configured to exert a first bias moment on said neutral arm when said conduction path is closed;

a spring support configured to support said bias spring, said spring support being fixedly arranged at said neutral housing;

a rotor pivotally arranged within said neutral housing and configured to displace said neutral arm and open said conduction path; and a drive pin configured to couple said rotor to the multipole circuit breaker, said rotor being responsive to the opening and closing action of the opening mechanism of the multipole circuit breaker;

wherein said rotor is in a first orientation when said conduction path is closed, a second orientation when said rotor makes contact with said neutral arm when opening, said conduction path, and a third orientation when said conduction path is open, said bias spring exerting a bias force on said neutral arm that is not transmitted to said rotor when said rotor is between said first and second orientations, and said bias spring exerting a bias force on said neutral arm that is transmitted to said rotor when said rotor is between said second and third orientations.

5. The neutral pole of claim 4, wherein said neutral arm opens subsequent to the opening of the plurality of contact arms of the multipole circuit breaker and closes prior to the closing of the plurality of contact arms of the multipole circuit breaker during an opening and closing action, respectively.

6. The neutral pole of claim 4, further wherein said bias spring exerts a second bias moment on said neutral arm when said conduction path is open, said first bias moment being of greater magnitude than said second bias moment.

7. The neutral pole of claim 6, further wherein said first and second bias moments are both in a direction for closing said conduction path.

8. The neutral pole of claim 4, wherein said spring support further comprises a plurality of non-translational slots and a plurality of translational slots, the neutral pole further comprising:

a first spring anchor pin pivotally received at said plurality of non-translational slots;

a second spring anchor pin pivotally and translationally received at said plurality of translational slots;

a plurality of neutral arm links each having a first hole at one end and a second hole at an opposite thereof, said first hole being pivotally coupled to said neutral arm and said second hole for receiving said second spring anchor pin; and a plurality of said bias springs arranged between said first and said second spring anchor pins.

9. The neutral pole of claim 4, wherein said neutral arm and said rotor have a common pivot pin, said common pivot pin being received at said spring support.

10. The neutral pole of claim 9, wherein said neutral arm is pivotally separable from said rotor.

11. A multipole circuit breaker, comprising:

a main housing;

a main conduction path having a plurality of contact arms configured to open and close an electrical circuit;

an operating mechanism configured to drive said contact arms; and a neutral pole, comprising:

a neutral housing in fixed arrangement with said main housing;

a neutral conduction path within said neutral housing having a neutral arm arranged to open and close said neutral conduction path;

a bias spring configured to exert a first bias force on said neutral arm when said neutral conduction path is closed;

a spring support configured to support said bias spring, said spring support being fixedly coupled to said neutral housing;

a rotor pivotally arranged within said neutral housing and arranged to displace said neutral arm and to open said neutral conduction path; and a drive pin configured to couple said rotor to said operating mechanism, said rotor being responsive to the opening and closing action of said operating mechanism;

wherein said neutral arm opens subsequent to the opening of said plurality of contact arms and closes prior to the closing of said plurality of contact arms during an opening and closing action, respectively.

12. The multipole circuit breaker of claim 11, wherein said rotor of said neutral pole is in a first orientation when said neutral conduction path is closed, a second orientation when said rotor makes contact with said neutral arm when opening said neutral conduction path, and a third orientation when said neutral conduction path is open, said bias spring exerting a bias force on said neutral arm that is not transmitted to said rotor when said rotor is between said first and second orientations, and said bias spring exerting a bias force on said neutral arm that is transmitted to said rotor when said rotor is between said second and third orientations.

13. The multipole circuit breaker of claim 11, wherein said neutral arm and said rotor have a common pivot pin, said common pivot pin being received at said spring support.

14. The neutral pole of claim 13, wherein said neutral arm is pivotally separable from said rotor.

* * * * *